United States Patent [19]

Mahoney et al.

[11] Patent Number: 4,588,188

[45] Date of Patent: May 13, 1986

[54] BACKBOARD REINFORCING APPARATUS

[76] Inventors: Kenneth J. Mahoney; Dana G. Rosenburg; Thomas H. Mahoney, all of P.O. Box 6, all of Dorrance, Kans. 67634

[21] Appl. No.: 660,715

[22] Filed: Oct. 15, 1984

[51] Int. Cl.[4] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 3,462,143 | 8/1969 | Bidelman et al. | 273/1.5 R |
| 4,285,518 | 8/1981 | Pearo | 273/1.5 R |
| 4,320,896 | 3/1982 | Engle et al. | 273/1.5 R |
| 4,377,283 | 3/1983 | Mahoney | 273/1.5 R |
| 4,395,040 | 7/1983 | White | 273/1.5 R |
| 4,433,839 | 2/1984 | Simonseth | 273/1.5 R |

OTHER PUBLICATIONS

Guardian Glass Backboard Circular 3-1982.
Porter Athletic equipment Co. Catalog, p. 5, 2-1961.
Sweet's Catalog File, 11.15 Me, pp. 1 & 2, 5-1982.

*Primary Examiner*—Paul E. Shapiro

*Attorney, Agent, or Firm*—Phillip A. Rein

[57] ABSTRACT

A backboard reinforcing apparatus operable to transfer forces against a basketball goal assembly to a main support frame to prevent breakage of a main glass backboard member. The backboard reinforcing apparatus includes the main glass backboard member supported about its outer periphery by a backboard and main support assembly; a transverse frame and goal support assembly connected to the backboard and main support assembly; and the basketball goal assembly connected to the transverse frame and goal assembly. Shocks are prevented from entering the main backboard member through the embodiments of (1) the use of a threaded goal support anchor members threaded into a goal support plate member and vertical support plate members to maintain positive spacing there between; and (2) the use of spacer members between a vertical anchor plate and a front goal mount plate to maintain the desired spacing. In another embodiment, an adjustable transverse frame and goal support assembly is provided having adjustable means to maintain a basketball rim assembly horizontal with the game playing surface.

17 Claims, 8 Drawing Figures

BACKBOARD REINFORCING APPARATUS

PRIOR ART

A patentability investigation was not conducted on the subject matter of this invention but the applicant herein is aware of the following patents which may be pertinent to this invention.

U.S. Pat. Nos. 4,285,518, 4,433,839, and, 4,320,896.

The Pearo patent discloses a basketball goal having a basketball rim bracket extending through an aperture in a glass backboard and attached to a backboard frame. This is a very simple device merely extended through an opening or aperture in the glass backboard but is not a satisfactory goal support system for collegiate or professional basketball playing situations.

The Simonseth patent teaches the disclosure of a basketball rim assembly and, more particularly, in FIGS. 10, 12, and 13, of attaching a basketball goal support system to a support bar which, in turn, is attached to a support frame extended about the periphery of a glass backboard member.

The Engle patent disclosed a shock absorbing assembly for a basketball backboard including front and rear plates secured to a support frame and having a baketball goal or rim assembly connected thereto. The purpose of this invention is to transfer forces against the rim assembly through the front and rear plates to the support frame to prevent breakage of the glass backboard member. A single support bolt "r" is illustrated as attaching the basketball rim assembly to the front and rear plates so as to transfer forces thereto down to the periphery support frame about the glass backboard member.

PREFERRED EMBODIMENT OF THE INVENTION

In one preferred embodiment of this invention, a basketball reinforcing apparatus is adapted to be supported above a basketball playing surface through a basketball backboard goal support assembly and having a basketball goal assembly secured to the basketball reinforcing assembly. The purpose of this invention is to transfer shocks against the basketball goal assembly received in the game of basketball and normally during dunking shots to prevent the breakage of a glass backboard member. The invention lies in the backboard reinforcing apparatus which includes (1) a main backboard member normally constructed of a glass material; (2) a backboard and main support assembly attached about the outer periphery of the main backboard member; and 3) a transverse frame and goal support assembly connected to the backboard and main support assembly. The main backboard member may be of a rectangular plate member shape or a fan shaped plate member having a resilient pad extended about the respective outer peripheries. The plate members are normally constructed of a glass material so as to be transparent therethrough and having a white line painted on an outer periphery but such white line is not necessary because of the elements of this invention. The peripheral backboard and main support assembly includes (1) backboard support assemblies; (2) corner or end support assemblies interconnecting the backboard support assemblies; and (3) a main backboard anchor and cover assembly adapted to retain the main backboard member within the backboard and main support assembly of this invention. The backboard support assemblies include a horizontal backboard support assembly and a vertical backboard support assembly having means thereon to receive a portion of the main backboard member thereon. The corner or end support assemblies each includes a vertical end support housing and a horizontal end support housing which are adapted to be repectfully connected to an adjacent portion of the above noted vertical backboard support housing and horizontal backboard support housing. The main backboard anchor and cover assembly includes cover plate members extended about the outer forward periphery of the backboard support assemblies and the corner or end support assemblies and provide a white peripheral marking about the main backboard member. Additionally, the cover plate members hold the main backboard member rigidly in place while allowing the glass to be easily replaced if broken. The main portion of this invention lies in the transverse frame and goal support assembly which includes (1) a vertical support assembly; (2) a lateral support assembly; and (3) a goal support assembly. The vertical support assembly includes upper and lower support brackets secured to the outer support frame or peripheral backboard and main support assembly and interconnected through a vertical strut member so as to transfer any shock forces outwardly to the peripheral outer support frame. The lateral support assembly includes a pair of lateral support plates secured to the vertical strut member and additionally secured to an upright vertical anchor plate which, in turn, is secured to the outer support frame. The goal support assembly includes a pair of spacer pads which are mounted on opposite sides of the main glass backboard member, a front goal mount plate against an outer one of the spacer pads, and the front goal mount plate secured by goal support anchor members to the vertical anchor plate. Next, the basketball goal rim structure can be attached to the front goal mounting plate so as to transfer forces therefrom through the front goal mounting plate to the vertical anchor plate, the vertical strut member, the upper and lower support brackets, and to the peripheral solid outer support frame. In one of the embodiments of this invention the front goal mounting plate is provided with threads therein which cooperate with threads in the vertical anchor plate when used with the externally threaded goal support goal members so as to achieve the positive spacing on each side of the glass backboard member so as to not contact nor provide pressure thereagainst. In other embodiment of this invention, spacer members are placed between the front goal mounting plate and the vertical anchor plate so as to isolate any shocks against a basketball rim from contacting or affecting the glass backboard member. In still other embodiment of this invention a goal adjustable transverse frame and support assembly is provided which has means which are operable to adjust the basketball goal assembly so that the rim member is always in a horizontal position. This embodiment provides for the necessary shock absorbing features as the other embodiments with the addition adjustable feature.

OBJECTS OF THIS INVENTION

One object of this invention is to provide a backboard reinforcing apparatus having a peripheral backboard and main support assembly about a main backboard member which adds substantial rigidity thereto to lessen the chance of breakage of the backboard member.

One further object of this invention is to provide a backboard reinforcing apparatus having a peripheral backboard and main support assembly about a main backboard member and a transverse frame and goal support assembly operable to transfer shock forces against a basketball rim member through the transverse frame and goal support assembly to the backboard and main support assembly to prevent breakage of the backboard member which is normally construed of glass.

Still, one further object of this invention is to provide a backboard reinforcing apparatus having a transverse frame and goal support assembly operable to receive and transfer shocks against a basketball goal rim assembly to an outer peripheral support frame.

One other object of this invention is to provide a backboard reinforcing apparatus including a transverse frame and goal support assembly having adjustable features so as to readily contact and adjust a basketball goal rim assembly to maintain the outer circular rim member in a horizontal and parallel position relative to the playing surface.

Another object of this invention is to provide a backboard reinforcing apparatus which is sturdy in construction; readily installed on existing basketball backboard and goal support systems; being substantially maintenance free; isolating the forces so as to not break the glass backboard member; and being adjustable in usage.

Various other objects, advantages, and features of the invention will become apparent to those skilled in the art from the following discussion, taken in conjunction with the accompanying drawings, in which:

FIGURES OF THE INVENTION

Figure 1:
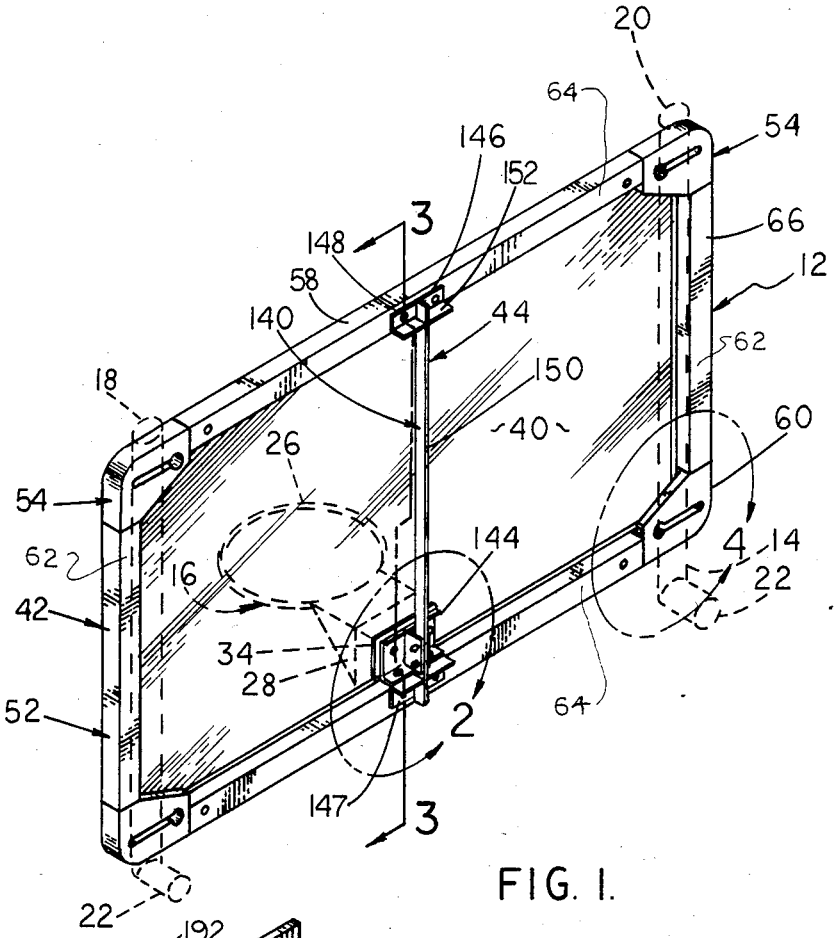
FIG. 1 is a perspective view of the backboard reinforcing apparatus of this invention with a backboard goal support assembly and basketball goal assembly indicated in dotted lines.

The following is a discussion and description of preferred specific embodiments of the new backboard reinforcing apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a backboard reinforcing apparatus of this invention, indicated generally at 12, is connected to and supported from a support surface or ceiling through a basketball backboard and goal support assembly 14 with a substantially convenitional or breakaway basketball goal assembly 16 attached to the backboard reinforcing apparatus 12.

The basketball backboard and goal support assembly 14 can be a type as supported from a ceiling through ceiling support rods 18 and 20 or a floor support assembly 22 which may be attached to the support surface. The floor support assembly 22 may have arcuate shaped support members holding the backboard reinforcing apparatus 12 normally with the aid of cables or the like. The actual means of supporting the backboard reinforcing apparatus 12 is not part of this invention but it is seen that our invention provides means thereon for connecting same to the backboard and goal support assembly 14.

The basketball goal assembly 16 includes a rim assembly 26 connected to a main support housing 28. The rim assembly 16 is operable on a normal manner to receive a basketball member there through during basketball play. However, it is noted that the basketball goal assembly 16 can be of a breakaway type to release the rim assembly 16 on applying excessive force thereto which aids in not injuring the player nor breaking the glass backboard members that are used in college and professional basketball play. This invention is drawn to further means for preventing the breaking of glass backboard members during play similar to purpose of the basketball goal structures now known in the prior art.

The backboard reinforcing apparatus 12 includes (1) a main backboard member 40 normally constructured of a glass material; (2) a peripheral backboard and main support assembly 42 mounted about the outer periphery of the main backboard 40; and (3) a transverse frame and goal support assembly connected 44 to the backboard and main support assembly 42 to support the basketball goal assembly 16 thereon as will be explained in detail. The main backboard member 40 can be constructured of a rectangular plate member 46 or of a fan shape plate member 48, each having a resilient pad 49 about their outer edges.

The backboard and main support assembly 42 includes (1) a backboard support assembly 52 extended about opposed, outer edges of the main backboard member 40; (2) corner or end support assemblies 60 position at each corner of the backboard member 40; and (3) a main backboard anchor and cover assembly 62 extended about the forward, outer peripheral edges of the backboard support assembly 52 and the end support assemblies 60. The backboard support assembly 52 includes opposed, horizontal backboard support housings 64 and opposed, vertical backboard support housings 66. Each of the backboard housings 64, 66 are substantially identical except for length and, therefore, only one need to be explained in detail. The horizontal backboard support housing 64 includes a lower base support section 68 integral with an upper base support section 70 as shown in the cross-sectional view of FIG. 3.

The lower base support section 68 is of a generally rectangular shape in transverse cross-section having a central cavity 72 and anchor holes opening 74 therethrough. The central cavity 72 is provided for economy and weight saving features plus means for interconnecting as will be explained.

The anchor opening 74 includes vertical holes 76 and horizontal holes 78 adapted to receive nut and bolt members thereto for anchoring purposes.

The upper base section 70 is also of a generally rectangular shape in transverse cross-section having (1) an upper central cavity 80; (2) a step section 82; and (3) an upper support surface 84. The central cavity 80 is a weight saving feature formed on extruding the structure out of an aluminum material. The stepped section 82 includes a vertical surface 86 adjoining at a lower edge a horizontal surface 88. The stepped section 82 is adapted to receive an outer peripheral and inside surface of the main backboard member 40 when mounted thereon. The upper surface 84 is adapted to receive a portion of the support structure of this invention thereon as will be explained.

Figure 4:
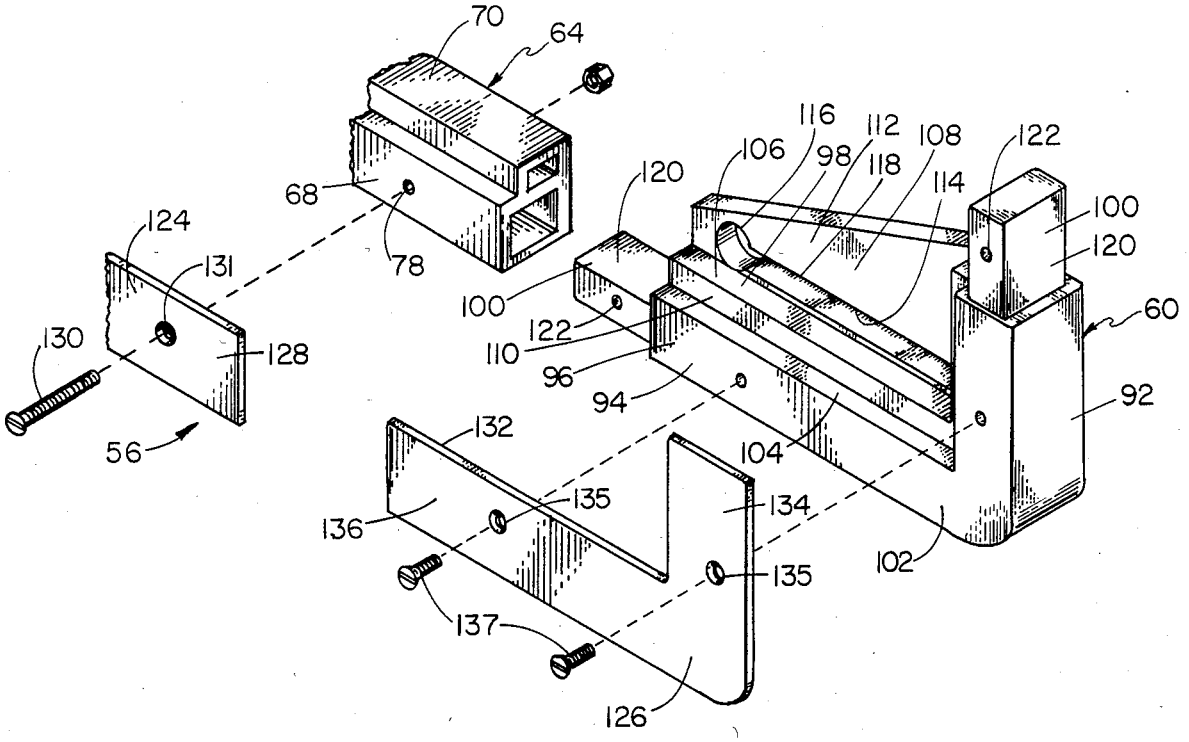
FIG. 4 is an exploded perspective view taken from the opposite side of the elements shown in circle "4" in FIG. 1.

As best shown in FIG. 4 in the exploded perspective view, each corner or end support assembly 60 is substantially identical having an upper end support housing 92 and a lower end support housing 94, each of which are substantially identical and only one need be described in detail. The lower end support housings 94 each include a support base member 96 integral with a backboard connector member 98 and having extended outwardly from the outer end a connector lug 100. Each support base member 96 includes a support section 102 integral with a horizontal support surface 104.

The integral backboard connector member 98 includes a stepped backboard section 106 integral with an upright connector section 108. The stepped backboard section 106 includes a vertical portion 110 to receive a portion of the main backboard member 40 thereagainst when in the assembled condition.

The upright connector section 108 includes a main connector body 112 having a key hole connector opening 114. Therein the key hole connector opening 114 is constructed of two (2) elements being as circular access hole 116 integral at one side with an elongated connector slot 118.

The laterally extend connector lugs 100 which are integrally formed with the support base member 96 includes connector bars 120 having transverse anchor holes 122 therein for reasons to be explained. The connector bars 120 are of a size to snugly within the respective central cavities 72 of the backboard support housing 64, 66 when in the assembled condition as will be explained.

As best noted in FIG. 4, the main backboard anchor and cover plate assembly 62 includes (1) a cover plate members 124 operable to cover the horizontal backboard support housings 64 and the vertical backboard support housings 62; and (2) corner cover plate members 126 adapted to cover the end support assemblies 60. The cover plate members 124 are of generally elongated rectangular plate shape having a plate member 128, adapted to receive an anchor nut and bolt member 130 through connector holes 131 for assembly purposes.

The corner cover plate members 126 are L-shaped plate members 132 adapted to be secured against the respective end support housings 92, 94 by anchor screws 137. Each plate member 132 is provided with a short leg section 134 integral with a long leg section 136, having connector holes 135 therethrough for assembly purposes.

Figure 2:
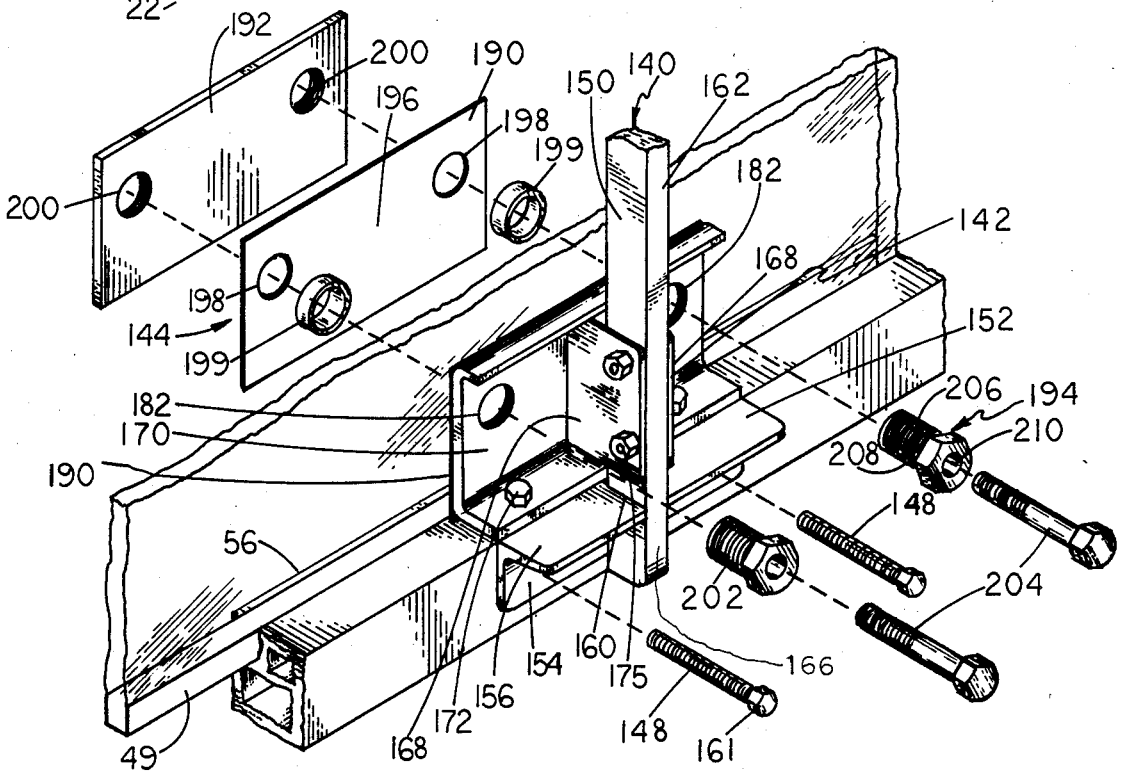
FIG. 2 is an exploded enlarged perspective view of the elements as shown in the circle 2 in FIG. 1.
Figure 3:
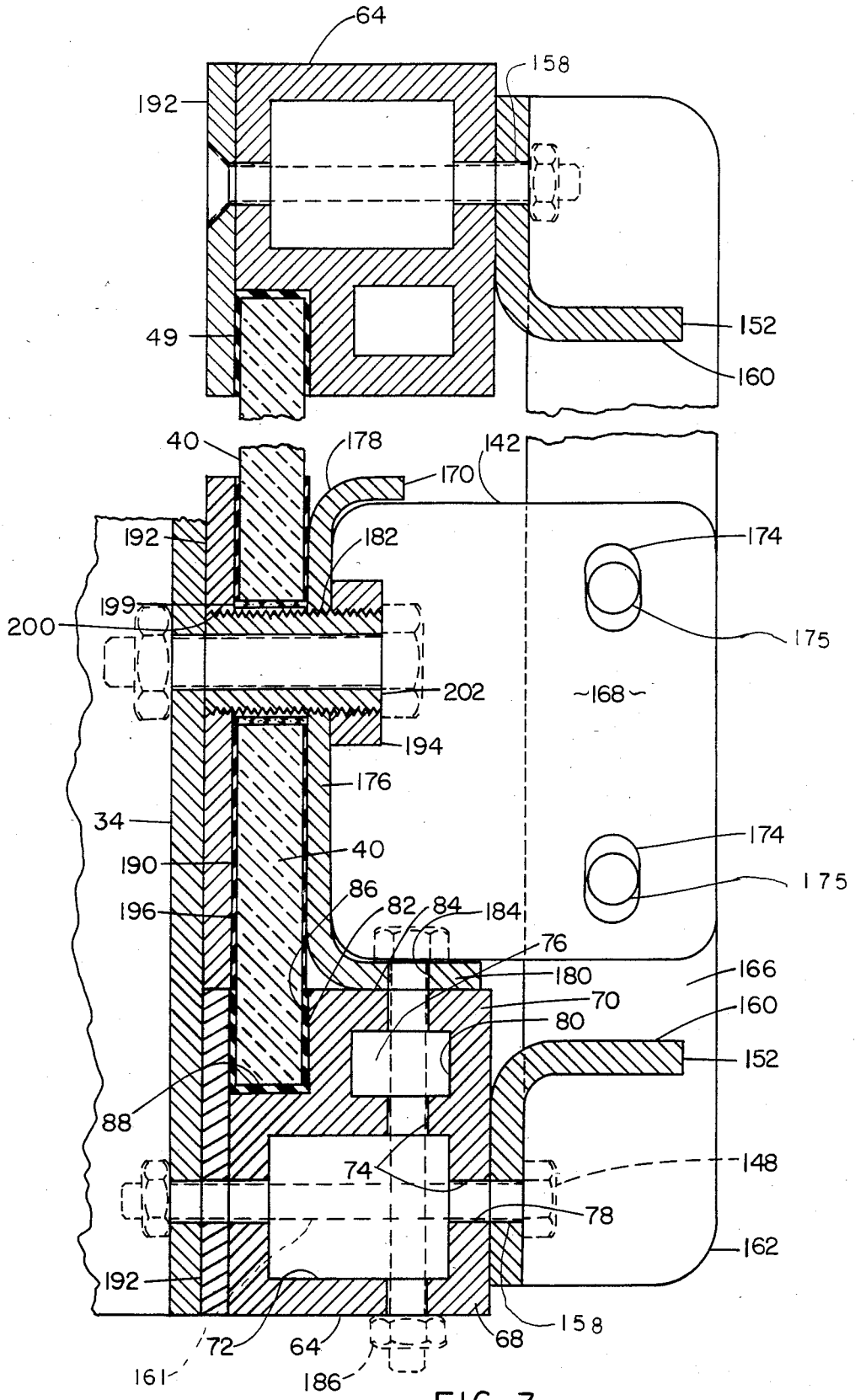
FIG. 3 is an enlarged foreshorten view taken along line 3—3 in FIG. 1.

As best noted in FIGS. 1, 2, and 3, the transverse frame and goal support assembly 44 is a major portion of this invention and includes (1) a vertical support assembly 140 connected to upper and lower portions of the peripheral backboard and main support assembly 42; (2) a lateral support assembly 142 connected to the vertical support assembly 140; and (3) a goal support assembly 144 connected to the lateral support assembly 142 and operable to receive the basketball goal assembly 15 connected thereto.

The vertical support assembly 140 includes upper and lower support brackets 146, 147 secured to upper and lower ends of a vertical strut member 150 by connector members 148 to the horizontal backboard support housings 64. The upper and lower support brackets 146, 147 are identical each being an angle iron member 152. Each angle iron member 152 includes a vertical leg section 154 integral with a horizontal leg section 156. The vertical leg section 154 is provided with spaced mounting holes 158 so as to be secured to the adjacent frame structure by the connector members 148.

Each horizontal leg section 156 is provided with a slot 160 therethrough to receive a portion of the vertical strut member 150 which welded to both leg sections 154 and 156 to provide substantial rigidity.

The connector members 148 each includes a nut and bolt member 161 which are extended through respective horizontal holes 78 in the horizontal backboard support housings 64 the main support housing assembly 58.

The vertical strut member 150 includes a rectangular bar member 162 having anchor holes 164 at a lower portion 166 thereof.

The lateral support assembly 142 includes lateral support plates 168 having an outer edge secured by connector members 175 to the vertical strut member 150 and an inner edge secured as by welding to a vertical anchor plate 170. There are two (2) lateral support plates 168, one being on each side of and abutting the strut member 152 in a clamped relationship due to the use of the connector members 175 which are nut and bolt members. A forward and lower edge of the respective lateral support plates 168 are secured as by welding to the vertical anchor plate 170. Each support plate 168 has a slot anchor hole 174 therein.

The vertical anchor plate 170 is of somewhat U-shape having a main anchor body 176 integral on the top edge with a top flange 178 and integral on the lower edge with a bottom flange 180. The main anchor body 176 is provided with two (2) spaced threaded spacer holes 182 for reasons to be explained.

The bottom flange 180 is provided with spaced connector holes 184 to each receive connector members 172 therethrough being a nut and bolt member 186 for securing to the respective horizontal backboard support housings 64.

The goal support assembly 144 includes (1) a pair of resilient spacer pads 190; (2) a front goal mount plate 192; and (3) goal support anchor members 194. The spacer pads 190 each consists of resilient rectangular pad member 196 having spaced connector holes 198 therein. Additionally, a pair of resilient hole spacers 199 may be utilized as shown in FIG. 3 to provide cushing around bolt members.

The front goal mount plate 192 is of a generally rigid material having a pair of threaded goal spacer holes 200 therein for reasons to be explained.

The two (2) goal support anchor members 194 each includes a spacer anchor member 202 and a goal support bolt member 204 to be associated therewith. Each spacer anchor member 202 includes a main body 206 provided with outer threads 208 thereon and a central opening 210 to receive the bolt member 204 therethrough.

Figure 5:
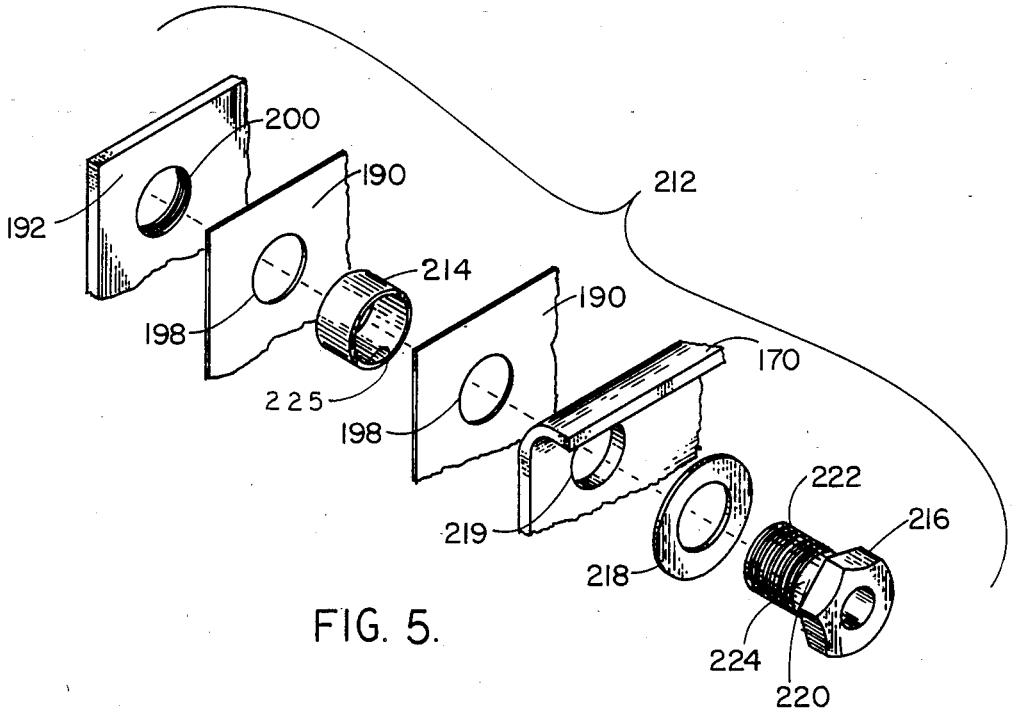
FIG. 5 is a fragmentary exploded perspective view of a second embodiment of a goal support assembly of the backboard reinforcing apparatus of this invention.

As noted in FIG. 5, a second embodiment of a spacer goal assembly 212 is provided. The spacer goal assembly 212 includes (1) the prior described pair of spacer pads 190; (2) the previously described front goal mount plate 192 having the threaded openings 200 therein; (3) a pair of spacer members 214; (4) the vertical anchor plate 170 but having holes 219 therein which are not threaded; (5) a pair of goal support anchor members 216; and (6) a spacer washer member 218.

The spacer members 214 are of a generally rigid construction adapted to contact the facing surfaces of the front goal mount plate 192 and the vertical anchor plate 170 to maintain a definite spacing therebetween so as not to place any stress or load on the main backboard member 40.

Each goal support anchor member 216 includes a main body member 220 having outer threads 222 thereon and a shoulder portion 224. It is noted that the outer diameter of the threads 222 of the anchor members 216 are adapted to be inserted through a central opening in the washer member 218; an opening 219 in the vertical anchor plate 170; openings 198 in the spacer pads 190; a central hole 225 in the rigid spacer member 214; and finally to be threaded within the threaded opening 200 in the spaced front goal mount plate 192.

Figure 6:
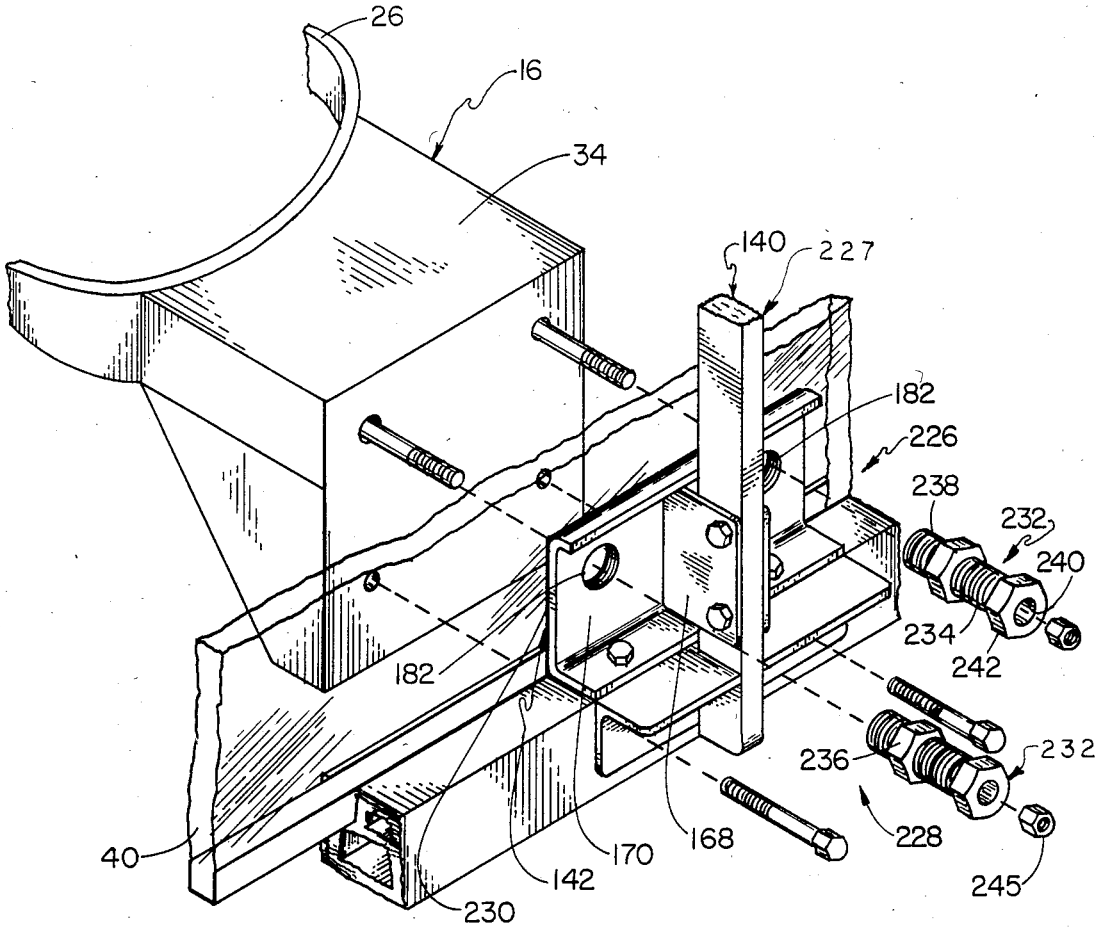
FIG. 6 is a fragmentary exploded perspective view of a third embodiment of a transverse frame and goal support assembly of the backboard reinforcing apparatus of this invention.
Figure 8:
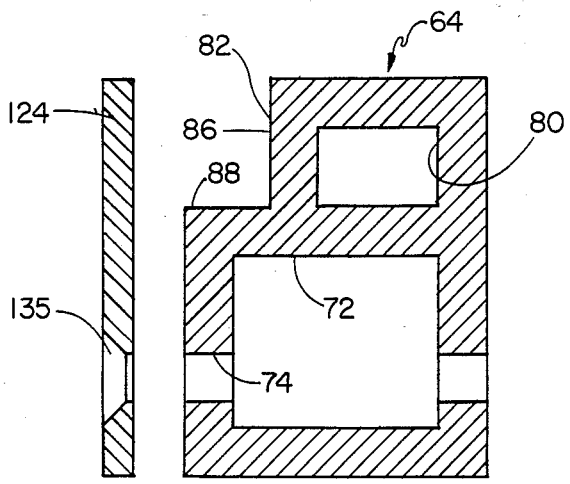
FIG. 8 is an enlarged sectional view of a horizontal backboard support housing with a cover member shown therewith of the backboard reinforcing apparatus of this invention.
Figure 7:
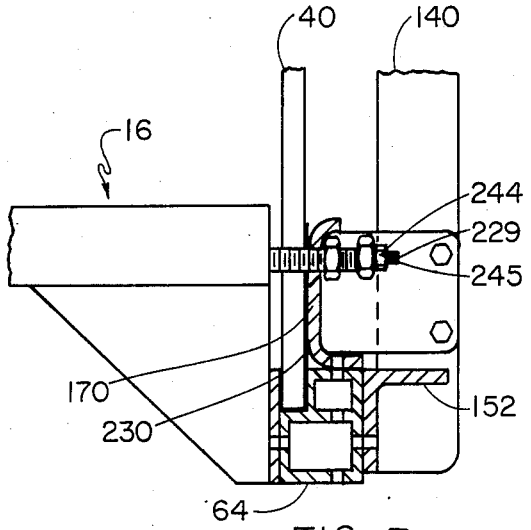
FIG. 7 is a fragmentary side elevational of the embodiment in FIG. 6 in the assembled condition.

In a third embodiment of this invention as shown in FIGS. 6 and 7, a backboard reinforcing apparatus 226 utilizes the same backboard member 40 and the backboard and main support assembly 42 with the change being noted in a transverse frame and goal support assembly 227. The frame and goal support assembly 227 includes (1) the prior described vertical support assembly 140; (2) the prior described lateral support assembly 142; and (3) an adjustable goal support assembly 228 which is connected to the basketball goal assembly 16 through a pair of goal connector members 229.

The lateral support assembly 142 includes the prior described lateral support plates 168 and the vertical anchor plate 170 having its threaded spacer holes 182 therein.

The goal support assembly 228 includes (1) a resilient backboard pad 230 mounted between the adjacent vertical support plate 170 and the main backboard member 40; and (2) a pair of adjustable goal contact members 232.

Each goal contact member 232 includes a main goal body member 234 held in an adjusted position through a lock nut member 236.

Each goal body member 234 includes a threaded main body 238 having a central opening 240 therein and provided with an outer end section 242.

Each goal connector member 229 includes a nut and bolt member 244 having an adjustable nut member 245 associated therewith.

The transverse frame and goal support assembly 226 is adapted to be adjustable so as to maintain the outer rim assembly 26 of the basketball goal assembly 16 in a horizontal position and can be readily adjusted during assembly or as further required in a manner to be explained in detail.

USE AND OPERATION OF THE INVENTION

The initial step of assembly of the backboard reinforcing apparatus 12 of the invention is to attach the peripheral backboard and main support assembly 42 about the outer periphery of the main backboard member 40. It is noted that the backboard member 40 can be of the rectangular or fan shaped type having the peripheral resilient pad 49 attached to the outer periphery thereof.

Next, the backboard support assemblies 52 are interconnected by the corner or end support assemblies 60 as best indicated in the exploded perspective view of FIG. 4. This is achieved by the insertion of the laterally extended connector lugs 100 of the respective upper and lower end support housings 92 and 94 into the adjacent respective central cavities 72 of the horizontal and vertical backboard support housings 64, 66. After inserted, the respective nut and bolt members 130 as shown in FIG. 3 are inserted in the respective holes 131, 78, 122, and 135 plus holes 74 at the appropriate points to interconnect the entire outer support frame.

After the steps are achieved to present a substantial rigid outer backboard main support assembly 42, it is seen that the transverse frame and goal support assembly 44 can be connected thereto. This involves the connection of the vertical support assembly 140 through the use of the upper and lower support brackets 146 and 147 interconnected to the adjacent frame structure being the horizontal backboard support housings 64. At this time, the vertical strut member 150 is also interconnected to the upper and lower support brackets 146 and 147 through the connector bolts 175 and through welding thereto.

The lateral support assembly 142 includes the vertical anchor plate 170 which is anchored in a plane closely adjacent to the back surface of the backboard member 40.

In the first embodiment as noted in FIGS. 2, and 3, the backboard member 40 is mounted with outer periphery thereof to be placed within and supported by the stepped section 82 and stepped backboard section 106 having the resilient pad 149 therebetween.

Next, the backboard anchor and cover assembly 62 is connected whereupon the plate members 128 and 132 are secured by the respective connector screw members 137. The plate members 128, 132 are painted white with baked on enamel so as to present a border about the main backboard member 40. In the next as noted in FIG. 2, the spacer pads 190 are placed between the backboard member 40 and the inner surface of the vertical anchor plate 170 with the holes 198 aligned with the threaded spacer holes 182. Next, the spacer anchor members 202 are aligned respective threaded holes 182; larger holes in the backboard member 40; and respective holes 198 in the resilient pad members 190.

Next, the front goal mount plate 192 is being held in a predetermined, specific lateral distance from the vertical anchor plate 170. The spacer anchor members 202 are screwed into the threads 182 and 200 simultaneously to function as achieveing a predetermined, desired spaced relationship between the vertical anchor plate 170 and the front goal mount plate 192. This operates to not contact nor achieve any compression against the main backboard member 40. This embodiment operates through the transverse frame and the goal support assembly 44 to transfer forces through the lateral support assembly 142; the vertical support assembly 140; and then to the outer peripheral backboard and main support assembly 42.

Finally, the bolt members 20 can be inserted through the central holes 210 in the spacer anchor members 202 for interconnecting the basketball goal assembly 16 thereto.

In referring to FIG. 5, another embodiment is shown having a spacer goal support assembly 212 substantially identical to that of FIG. 1 except that the vertical anchor plate 170 has a larger opening 219 which is not threaded and will utilize spacer members 214 each spacer member 214 has a larger diameter than the threaded holes 200 in the front goal mount plate 192 and the holes 219 in the vertical mount plate 170. The assembly is substantially identical as that described for the first embodiment except that the goal support anchor members 216 are adapted to be inserted through the central hole in the washer 218; the hole 219 in the vertical mount plate 170; the holes 198 in the pad members 190; the central hole 225 in the spacer members 214. It is noted that the spacer members abut the facing surfaces of the vertical mount plate 170 and the front goal mount plate 192 so as to achieve a positive spacing thereof and prevent contact and excessive forces from being inserted on the main backboard member 40.

The adjustable embodiment is shown in FIGS. 6 and 7 wherein the vertical anchor plate 170 is utilized with a resilient backboard pad 230 placed against the main backboard member 40. In this embodiment the goal contact members 232 include the goal anchor members 234 having a threaded main body 238 which are threadably mounted within the threaded holes 182 in the vertical anchor plate 170. Next, the goal connector members 229 are mounted through a central opening 240 in the goal anchor members 234 and the basketball goal assembly 16 is connected thereto. Next, each goal anchor member 234 is rotated as desired so as to move in an horizontal axis while contacting a back of the basketball goal assembly 16 until the rim assembly 26 extends in a horizontal plane. This is the desired position of adjustment whereupon the adjustable nut members 245 are threaded up on the threaded main body 238 of the goal anchor members 234 against a back surface of the vertical anchor plate 170. Then the nut and holt members 244 can be tightened as desired so as to hold the basketball goal member 16 in the rigid adjusted position.

As noted in this adjustable embodiment, all the shocks applied to the basketball goal rim assembly 16 is transferred through the contact of the goal anchor members 234; outwardly to the transverse frame and goal support assembly 226; backboard support assemblies 52; and the goal support assembly 14 prevent damage to the backboard member 40.

It is seen that the backboard reinforcing apparatus of this invention is easy to attach to existing backboard members; substantially rigid in construction; reliable in use, and removes all the forces which may be applied against a glass backboard member to prevent the undesired breakage thereof.

While the invention had been described in conjunction with preferred specific embodiments thereof, it is to be understood that this description is intended to illustrate and not to limit the scope of the invention, which is defined by the following claims.

I claim:

1. A backboard reinforcing apparatus adapted to be suspended above a basketball playing surface and having a basketball goal assembly connected thereto, comprising:

(a) a main backboard member;

(b) a backboard and main support assembly to receive and support a main backboard member about its periphery;

(c) a transverse frame and goal support assembly secured between opposed portions of said backboard and main support assembly; and (d) said frame and goal support assembly includes a lateral suport assembly to receive and support said basketball goal assembly thereon;

whereby forces applied against said basketball goal assembly during basketball play are transferred to said frame and goal support assembly and said backboard and main support asesmbly and not to said backboard member to prevent breakage thereof.

2. A backboard reinforcing apparatus as described in claim 1, wherein:

(a) said backboard and main support assembly having a main support assembly interconnected by end support assemblies and having a main backboard anchor and cover assembly connected thereto;

(b) said main support assembly and said end support assemblies each having support housings with a stepped section therein; and (c) said stepped sections adapted to receive an outer edge and back side of said main backboard member thereagainst in order to hold same.

3. A backboard reinforcing apparatus as described in claim 2, wherein:

(a) said backboard anchor and cover assembly having cover plate members secured against an outer front portion of said main backboard member to as to hold same against lateral movement from respective ones of said stepped sections.

4. A backboard reinforcing apparatus as described in claim 3, wherein:

(a) said cover plate members placed about the outer periphery of said main backboard member being white in color to achieve the outer outline of said main backboard member so that said backboard member does not need to be repainted whereby said cover members are easily removed as required for maintenance and painting operations thereto.

5. A backboard reinforcing apparatus as described in claim 1, wherein:

(a) said transverse frame and goal support assembly including (1) a vertical support said backboard and main support assembly; (2) a lateral support assembly secured to said vertical support assembly; and (3) a goal support assembly connected to said lateral support assembly; and (b) said vertical support assembly includes upper and lower support brackets secured to said backboard and main support assembly and a vertical strut member mounted between said upper and lower support brackets to provide a rigid support structure.

6. A backboard reinforcing apparatus as described in claim 5, wherein:

(a) said upper and lower support brackets include angle iron members secured to said backboard and main support assembly and having horizontal and vertical leg sections to which said vertical strut member is welded thereto to provide substantial rigidity.

7. A backboard reinforcing apparatus as described in claim 5, wherein:

(a) said lateral support assembly includes lateral support plates secured to said vertical strut member and a vertical anchor plate secured to said lateral support plates and said backboard and main support assembly so as to achieve substantial rigidity.

8. A backboard reinforcing apparatus as described in claim 7, wherein:

(a) said vertical anchor plate having a pair of threaded spacer holes therein;

(b) said goal support assembly includes a front goal mount plate member and goal support anchor members;

(c) said front goal plate member having a pair of spaced threaded goal spacer holes in axial alignment with said threaded spacer holes in said vertical anchor plate;

(d) said goal support anchor members having spacer anchor members with a main body having outer threads thereupon; and (e) said spacer anchor members are threaded in said threaded goal spacer holes and said front goal mount plate and said threaded spacer holes in said vertical anchor plate when they are placed at a predetermine spaced relationship so as to anchor the same at the desire space relationship so that no load or compression is applied to said main backboard member when in the usage condition.

9. A backboard reinforcing apparatus as described in claim 8, wherein:

(a) each of said spacer anchor members having a main body with said outer threads and a central hole therein;

wherein said central hole is operable to receive bolt members therethrough in order to anchor the basketball goal assembly thereto whereby loads placed thereon are transferred through said transverse frame and goal support assembly to said backboard and main support assembly whereby no loads are placed against said main backboard member to prevent breakage thereof.

10. A backboard reinforcing apparatus as described in claim 8, wherein:

(a) said goal assembly includes a pair of resilient spacer pads placed on opposite sides of said main backboard member.

11. A backboard reinforcing apparatus as described in claim 8, wherein:

(a) said spacer goal assembly includes a pair of spacer members; said spacer members placed between said vertical anchor plate and said front goal mount plate adapted to maintain a predetermine distance therebetween which is greater than the thickness of said main backboard member so that no forces are applied thereto when said basketball goal assembly has shocks applied thereto.

12. A backboard reinforcing apparatus as described in claim 1, wherein:

(a) said backboard and main support assembly includes backboard support housings interconnected by end support assemblies and having a backboard anchor and cover assembly connected thereto;

(b) said backboard support housings having horizontal and vertical backboard support housing having outer ends interconnective by said end support assemblies;

(c) said horizontal backboard support assembly having an upper base support section integral with a lower base support section; and (d) said basketball goal assembly anchored to said transverse frame and goal assembly to prevent forces applied to said basketball goal assembly for being transferred to said main backboard member to prevent breakage thereof.

13. A backboard reinforcing apparatus as described in claim 12, where:

(a) said backboard anchor and cover assembly includes rectangular plate cover members anchored to said horizontal and vertical backboard support housings and said end support assemblies and operable to hold said main backboard member in the desired place but allowing the same to be readily removed for replacement if deemed necessary.

14. A backboard reinforcing apparatus adapted to be suspended above a basketball playing surface and having a basketball goal assembly connected thereto, comprising:

(a) a main backboard member;

(b) a backboard and main support member assembly to receive and support a main backboard member about its periphery;

(c) a transverse frame and goal support assembly secured between opposed upper and lower portions of said backboard and main support assembly; and (d) said frame and goal support assembly includes a lateral support assembly to receive and support said basketball goal assembly thereon;

whereby forces applied against said basketball assembly during basketball play are transferred to said frame and goal support assembly and said backboard and main support assembly and not to said backboard member.

15. A backboard reinforcing apparatus as described in claim 14, wherein:

(a) said transverse frame and goal support assembly includes a vertical support assembly connect to said backboard and main support assembly; a lateral support assembly secured to said vertical support assembly and a goal support assembly secured to said lateral support assembly;

(b) said lateral support assembly includes a vertical anchor plate secured to said vertical support member; and (c) said goal support assembly includes a spacer goal support assembly having a front goal mount plate which is secured to said vertical anchor plate and a goal support anchor member threadedly mounted in said vertical anchor plate so as to be axially moveable relative thereto and having an outer end thereof abutting the basketball goal assembly;

whereby said goal support anchor member is axially adjustable and maintained in contact with said basketball goal assembly so as to maintain the same in the proper desired position having a rim member thereof maintained horizontal to a playing support surface.

16. A backboard reinforcing apparatus as described in claim 14, wherein:

(a) said transverse frame and goal support assembly includes a vertical support assembly connect to said backboard and main support assembly, a lateral support assembly secured to said vertical support assembly, and a goal support assembly secured to said lateral support assembly;

(b) said lateral support assembly includes a vertical anchor plate secured to said vertical support member; and (c) said goal support assembly having a spacer member mounted against said front goal mount plate and said vertical anchor plate to maintain a predetermined distance therebetween so that no load is applied to said backboard member.

17. A backboard reinforcing apparatus as described in claim 14, wherein:

(a) said transverse frame and goal support assembly includes a vertical support assembly connected to said backboard and main support assembly; a lateral support assembly secured to said vertical support assembly; and a goal support assembly securd to said lateral support assembly; and b) said goal support assembly includes adjustable means engagable with said basketball goal assembly to hold a rim member in a horizontal plane playing position.

* * * * *